United States Patent [19]

Weiss et al.

[11] 4,167,275

[45] Sep. 11, 1979

[54] SKI BRAKE

[75] Inventors: Klaus Weiss, Leonberg; Heinz Luithlen, Rutesheim, both of Fed. Rep. of Germany

[73] Assignee: Vereinigte Baubeschlagfabriken Gietsch & Co. GmbH, Leonberg, Fed. Rep. of Germany

[21] Appl. No.: 873,125

[22] Filed: Jan. 30, 1978

Related U.S. Application Data

[63] Continuation-in-part of Ser. No. 744,780, Nov. 14, 1976, abandoned.

[30] Foreign Application Priority Data

Dec. 2, 1975 [DE] Fed. Rep. of Germany ..... 2554110

[51] Int. Cl.[2] ..... A63C 7/10

[52] U.S. Cl. ..... 280/605

[58] Field of Search ..... 280/605, 604, 636; 188/5

[56] References Cited

U.S. PATENT DOCUMENTS

| | | | |
|---|---|---|---|
| 3,873,108 | 3/1975 | Lacarrau et al. | 280/604 |
| 3,930,659 | 1/1976 | Salomon | 280/605 |
| 4,012,057 | 3/1977 | Courvoisier | 280/605 |
| 4,036,509 | 7/1977 | Schwarz | 280/605 |

FOREIGN PATENT DOCUMENTS

| | | | |
|---|---|---|---|
| 2057650 | 5/1972 | Fed. Rep. of Germany | 280/636 |
| 660942 | 7/1929 | France | 280/605 |

*Primary Examiner*—David M. Mitchell

[57] ABSTRACT

Ski brake comprising a bail rotatably mounted about a fixed transverse axis on a ski having two brake arms extending alongside the ski on one side of the axis and a pedal on the other side of the axis, a flexural spring fastened to the pedal which extends to a supporting surface on top of the ski in all rotational positions of the bail. The spring is resiliently biased relative to the pedal such that in the absence of a ski boot on the pedal the spring rotates the bail into a braking position wherein the brake arms project below the ski. When a ski boot is placed on the pedal the bail is rotated against the bias of the spring into an inactive position wherein the brake arms are located in the plane of or above the ski. A roller can be provided at the end of the spring to roll on the supporting surface and/or the supporting surface can be provided with friction reducing properties.

15 Claims, 4 Drawing Figures

SKI BRAKE

Figure 1:
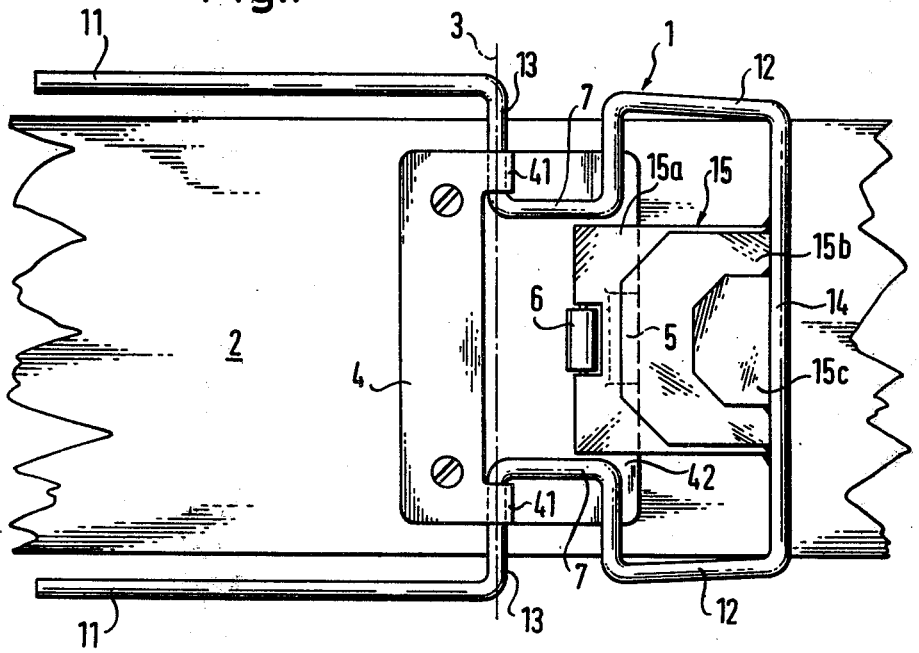

This application is a continuation-in-part of my earlier application Ser. No. 744,780 filed Nov. 14, 1976, now abandoned.

BACKGROUND OF THE INVENTION

The invention concerns a ski brake having a bail rotatably mounted about a transverse axis that is fixed relative to the ski, which on one side of the axis of rotation has two brake arms extending alongside the ski and, on the opposite side of the axis of rotation, has a pedal engaging the bottom of the shoe, to which there is fastened at a point remote from the axis of rotation a deploying means which in every rotational position of the bail extends to a supporting surface on top of the ski, which in its entire length lies on the same side of the axis of rotation as the pedal, and which is resiliently biased relative to the pedal towards the deployed position of the bail, such that the deploying means swings the bail into the braking position wherein the brake arms project from the bottom of the ski and the pedal projects from the top side of the ski, and also such that, with the ski boot placed on the pedal, the bail is swung against the force of the deploying means to the inactive position in which the brake arms are situated alongside or above the ski and the pedal lies beneath the ski boot affixed in the ski binding.

In a known ski brake of this kind (U.S. Pat. No. 4,036,509), the bail consists of a single wire which is so bent that the two brake arms, the transverse axis of rotation, the pedal and the deploying means are formed from it. It is disadvantageous in this known construction that the wire used for making the bail has to fulfill the strength requirements of the brake arms as well as the spring properties required for deploying the bail into the braking position. It is thus impossible to adapt the wire material in an optimum manner to both of these requirements.

THE INVENTION

It is the object of the present invention to create a ski brake of the kind described in the beginning, in which the spring properties responsible for the resilient biasing of the deploying means can be selected independently of the material properties of the brake arms and of the bail. The invention is thus intended to create a ski brake which can be designed in an optimum manner with regard to strength and to spring characteristics.

To achieve this object, the invention provides for the deploying means to be formed of at least one flexural spring extending in the braking position from the pedal to a point on the supporting surface situated on the same side of the axis of rotation as the pedal, and for friction reducing means to be provided at the end of the flexural spring and/or on the supporting surface.

On the basis of this construction, the brake arms and the pedal can be designed solely from the viewpoint of the strength required for the braking function. Optimum spring properties for the deployment of the brake arms can be achieved equally well by designing the flexural spring, which is to be fastened to the pedal, such that it will have these properties; this can be accomplished entirely independently of the choice of the material and configuration of the brake arms and pedal. The reduction of friction between the flexural spring and the supporting surface can be accomplished in any desired manner, as for example by rounding off the extremities of the flexural spring or by the provision of antifriction coverings on the extremities of the flexural spring or on the supporting surface. It is preferred, however, to mount, on a transverse axis on the end of the flexural spring which points towards the supporting surface, a roller which can roll on the supporting surface. It is furthermore advantageous for the supporting surface to be provided on a plate fastened to the ski, the plate having advantageously a surface which has a friction reducing properties.

To facilitate the swinging of the ski brake from the braking position to the inactive position at the beginning of the movement, in the case of flexural springs which are in a very steep attitude towards the supporting surface, the supporting surface in an especially preferred embodiment has an inclined plane sloping towards the axis of rotation in the area where it is engaged by the flexural spring when the bail is in the braking position.

The achievement of the relatively great spring excursion required for the deployment of the brake arms is aided by the fact that the flexural spring is a leaf spring which is bent downwardly from the plane of the pedal when the bail is in the braking position. It is especially advantageous if a plurality of leaf springs fastened to the pedal are arranged parallelly, lying preferably flat one on the other. In this manner, too, a great spring force can be achieved while retaining the large spring excursion. This embodiment renders especially apparent the advantage that can be obtained when the spring properties of the deploying means and the strength properties of the brake arms and pedal can be established indepedently of one another.

Since the strength of the flexural spring is to be less when the ski brake is fully deployed than it is when the brake is in the inactive position, provision is made in an additional advantageous embodiment for only the bottommost leaf spring to extend all the way to the supporting surface. The leaf springs above the bottommost leaf spring are furthermore advantageously made successively shorter. In this manner a progressively increasing spring force is achieved as the ski brake is shifted from the braking position to the inactive position.

In the case of ski brakes for children's skis it is sufficient to provide two superimposed leaf springs. In ski brakes designed for adults, however, it is desirable to have three superimposed leaf springs.

PREFERRED EMBODIMENTS OF THE INVENTION

Figure 2:
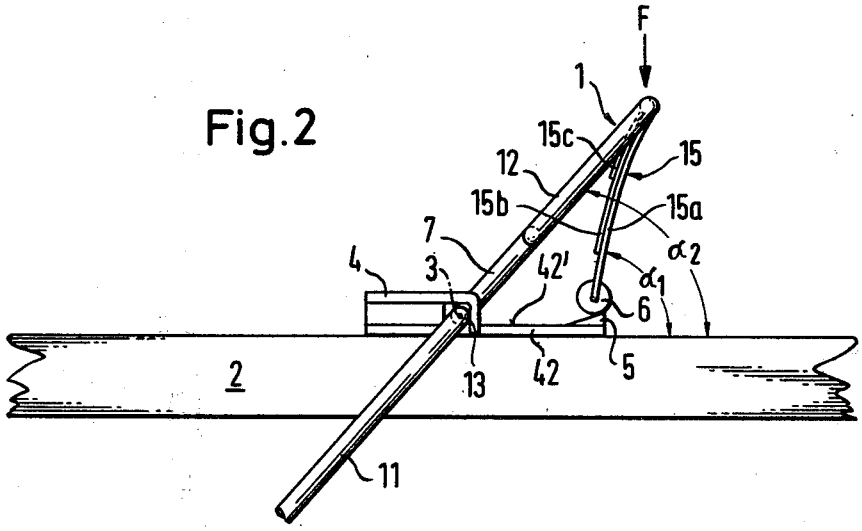
Figure 3:
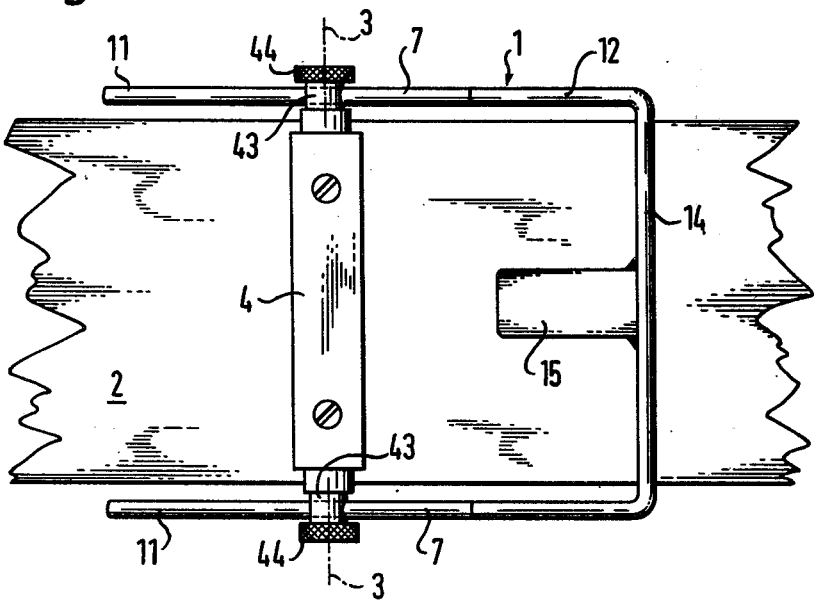
Figure 4:
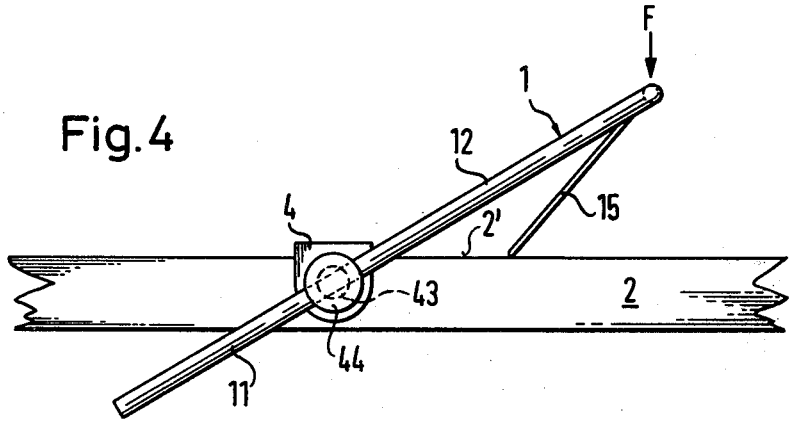

The invention will now be described with the aid of examples of its embodiment, in conjunction with the appended drawings wherein FIG. 1 is a diagrammatic top view of a ski brake of the invention in the inactive position with the brake arms situated alongside the ski and with the pedal lying flat on the top surface of the ski, FIG. 2 is a diagrammatic side view of the ski brake of FIG. 1 in the deployed, braking position, FIG. 3 is a top view similar to FIG. 1 of an additional simiplified embodiment, and FIG. 4 is a side view similar to FIG. 2 of the embodiment shown in FIG. 3.

In FIGS. 1 and 2, a plate 4 is fastened to the top surface of the ski 2, and bears laterally two bearings 41 whose axis 3 runs transversely of the ski 2 and in which the transverse axis 13 of a ski brake 1 is so journaled that it can turn only about the axis 3, but otherwise cannot shift relative to the ski 2. From the transverse axis 13 the brake arms 11 extend on both sides of the ski 2, and when they are in the braking position of FIG. 2 they project from the bottom of the ski at a more or less great angle. Two stems 7 extend away from the transverse axis 13 in the direction opposite that of the brake arms 11, and the pedal 12 of the ski brake 1, which enters into engagement with the ski boot, is fastened to them.

The brake arms 11, the transverse axis 13, the stems 7 and the pedal 12 are bent from a single piece of wire as shown in FIGS. 1 to 4, the material and the diameter of the wire being selectable solely on the basis of strength considerations.

Three leaf springs 15*a*, 15*b* and 15*c* forming a flexural spring 15 are fastened in the manner shown to the end 14 of the pedal 12 which points away from the axis of rotation 3, such that they are bent downward from the plane of the pedal 12 in the braking position repesented in FIG. 2. In FIGS. 1 and 2, the method of mounting the leaf springs 15*a*, 15*b* and 15*c* is represented diagrammatically as welding. The ends of the leaf springs can also be fastened to the pedal 12 by other methods, for example by bolting or riveting. The important thing is for the force produced by the flexural spring 15 to be able to be transmitted to the pedal 12 and thus to the brake arms 11.

In FIGS. 1 and 2, the bottomost leaf spring 15*a* extends all the way to an area of the surface 42' of a prolongation 42 of the plate 4 which is situated on the same side of the transverse axis 13 as the brake pedal 12.

On the end of leaf spring 15*a* which points away from the supporting surface 42' there is provided a roller which lies on the surface 42' when the brake is in the inactive position represented in FIG. 1, and in the braking position represented in FIG. 2 it lies on an inclined plane 5 provided on the prolongation 42 at the end thereof which points away from the transverse axis 13.

The leaf springs 15*b* and 15*c* lying directly on the bottommost leaf spring 15*a* and extending parallel thereto, are, as shown in FIGS. 1 and 2, shorter than the bottommost leaf spring 15*a*, as is desirable for the attainment of the desired spring characteristic. In the braking position, the angle $\alpha 1$ between the ski surface and flexural spring 15 is larger than the angle $\alpha 2$ between the brake pedal 12 and the ski surface, on the basis of the arrangement in accordance with the invention.

The manner of the operation of the ski brake of FIGS. 1 and 2 is as follows:

When the ski boot is not in place, the brake pedal 12 is deployed to the braking position by the bias of the flexural spring 15. In the position shown in FIG. 2, the flexural spring 15 is virtually unbiased. If then a boot sole is pressed down onto the pedal 12 in the direction of the arrow F of FIG. 2, the roller 6 first rolls downwardly on the inclined plane 5 and then along the surface 42' towards the transverse axis 3. At the same time the flexural spring 15 is bent towards the plane of the pedal 12 under increasing bias and with diminishing curvature, until it finally assumes a substantially flat form in the inactive position of brake arms 11 shown in FIG. 1, and comes to rest in the plane of the pedal 12. In this position the flexural spring has the greatest bias.

The ski brake 1 is held in the position shown in FIG. 1 during normal skiing by the ski boot held on the ski 2 by the ski binding which is not shown.

If the ski boot comes free from the safety ski binding and thus from the ski—in the case of a fall, for example—the flexural spring 15 will strive to reassume its unbiased position shown in FIG. 2. This produces a torque which causes the roller 6 to run along the surface 42' to the inclined plane 5, the brake arms 11 being deployed to the position represented in FIG. 2. The brake arms 11 therefore finally assume the braking position seen in FIG. 2.

The inclined plane 5 at the end of the path of the roller 6 has the purpose of reducing the force required for the return from the braking position shown in FIG. 2, in the initial part of the swinging movement of the arms 11. The inclination and length of the inclined plane 5 must thus be selected accordingly.

In the embodiment shown in FIGS. 3 and 4, the brake arms 11 and the pedal 12 are formed by a wire bent to a U shape, which is fastened by two set screws 44 to pivots 43 rotatable about the transverse axis 3. The pivots 43 are disposed on a plate 4 fastened to the ski 2.

In the embodiment shown in FIGS. 3 and 4, a single leaf spring 15, which directly engages the surface 2' of the ski 2, extends inwardly from the end 14 of pedal 12 which points away from the axis of rotation 3, and downwardly also, in FIG. 4. The surface 2' and the lower end of the leaf spring 15 are to be provided with friction reducting means or are to be constructed for the reduction of friction such as to enable the bottom end of the leaf spring 15 to slide on the surface 2'. If desired, the leaf spring 15 could bear in the area of surface 2' a roller 6 as in the embodiment shown in FIGS. 1 and 2.

The operation of the embodiment shown in FIGS. 3 and 4 is similar to that of FIGS. 1 and 2, i.e., when the ski boot is installed in the direction of the arrow F in FIG. 4, the leaf spring 15 is forced with increasing bias substantially into the plane of the pedal 12. Upon the release of the ski boot from the ski surface, the leaf spring 15 which is in the plane of the pedal 12 in FIG. 3, returns the pedal 12 back to the braking position shown in FIG. 4.

We claim:

1. Ski brake comprising a bail rotatably mounted about a fixed transverse axis on a ski, said bail having two brake arms extending alongside the ski on the one side of said axis and a pedal on the other side of said axis, a distinct deploying means fastened at one end to said pedal at a point remote from said axis, a supporting surface on top of the ski, said deploying means extending with another end thereof to said supporting surface in every rotational position of said bail and being movable along said supporting surface, said deploying means being on the same side of said axis as the pedal and being resiliently biased relative to said pedal such that in the absence of a ski boot on said pedal said deploying means is adapted to move along said supporting surface and rotate said bail into a braking position wherein said brake arms project below the bottom of the ski and the pedal projects above the top of the ski, said bail being rotated against the bias of said deploying means by a ski boot being placed on said pedal into an inactive position wherein said brake arms are located in the plane of or above said ski and the pedal lies beneath the ski boot affixed in a ski binding, said deploying means being formed by at least one flexural spring, which, when said bail is in said braking position extends to a point on said supporting surface which is on the same side of said axis as said pedal, and friction reducing means comprising a distinct member having a curved surface supported on said flexural spring at said other end for contact of its curved surface with said supporting surface.

2. Ski brake according to claim 1, characterized by said member having a curved surface comprising a roller mounted for rotation about a transverse axis at the said other end of said flexural spring for rolling on said supporting surface.

3. Ski brake according to claim 1, characterized by a plate fastened on the ski, said supporting surface being provided on said plate.

4. Ski brake according to claim 2, characterized by an inclined plane on said supporting surface which descends towards said fixed transverse axis, said plane being in the area where said roller rests when the bail is in the braking position.

5. Ski brake according to claim 1, characterized in that said flexural spring comprises a plurality of leaf springs arranged in parallel and inclined downwardly from the plane of the pedal when the bail is in the braking position.

6. Ski brake according to claim 5, characterized in that said leaf springs lie flat on each other.

7. Ski brake according to claim 5, characterized in that only the bottom leaf spring extends all the way to said supporting surface.

8. Ski brake according to claim 7, characterized in that the leaf springs lying on the bottom leaf spring are successively shorter.

9. Ski brake according to claim 5, characterized in that there are provided two superimposed leaf springs.

10. Ski brake according to claim 5, characterized in that there are provided three superimposed leaf springs.

11. Ski brake according to claim 1, characterized by said bail having a pair of stems disposed in lateral spaced relationship extending from said fixed transverse axis to said pedal, said flexural spring being disposed between said stems.

12. Ski brake comprising a bail rotatably mounted about a fixed transverse axis on a ski, said bail having two brake arms extending alongside the ski on one side of said axis and a pedal on the other side of said axis, a deploying means fastened at one end to said pedal at a point remote from said axis, a supporting surface on top of the ski, said deploying means extending with another end thereof to said supporting surface in every rotational position of said bail and being movable along said supporting surface, said deploying means being on the same side of said axis as the pedal and being resiliently biased relative to said pedal such that in the absence of a ski boot on said pedal said deploying means is adapted to rotate said bail into a braking position wherein said brake arms project below the bottom of the ski and the pedal projects above the top of the ski, said bail being rotated against the bias of said deploying means by a ski boot being placed on said pedal into an inactive position wherein said brake arms are located in the plane of or above said ski and the pedal lies beneath the ski boot affixed in a ski binding, said deploying means being formed by at least one flexural spring, which, when said bail is in said braking position extends to a point on said supporting surface which is on the same side of said axis as said pedal, and in which said supporting surface included an inclined plane which descends towards said axis, said plane being located in an area corresponding to positions of said deployment means in the latter stages of deployment of the ski brake.

13. Ski brake according to claim 12, characterized in that said flexural spring comprises a leaf spring having a smoothly curved end which contacts said inclined plane when the bail is in the braking position.

14. Ski brake according to claim 12, characterized in that said flexural spring comprises a plurality of leaf springs arranged in parallel.

15. Ski brake comprising a bail rotatably mounted about a fixed transverse axis on a ski, said bail having two brake arms extending alongside the ski on one side of said axis and a pedal on the other side of said axis, a deploying means fastened at one end to said pedal at a point remote from said axis, a supporting surface on top of the ski, said deploying means extending with another end thereof to said supporting surface in every rotational position of said bail and being movable along said supporting surface, said deploying means being on the same side of said axis as the pedal and being resiliently biased relative to said pedal such that in the absence of a ski boot on said pedal said deploying means is adapted to rotate said bail into a braking position wherein said brake arms project below the bottom of the ski and the pedal projects above the top of the ski, said bail being rotated against the bias of said deploying means by a ski boot being placed on said pedal into an inactive position wherein said brake arms are located in the plane of or above said ski and the pedal lies beneath the ski boot affixed in a ski binding, said deploying means being formed by a plurality of leaf springs arranged in parallel, one of said leaf springs being longer than any other leaf spring and extending in said braking position to a point on said supporting surface which is on the same side of said axis as said pedal.

* * * * *

UNITED STATES PATENT AND TRADEMARK OFFICE

CERTIFICATE OF CORRECTION

PATENT NO. : 4,167,275

DATED : September 11, 1979

INVENTOR(S) : Klaus Weiss et al.

It is certified that error appears in the above—identified patent and that said Letters Patent is hereby corrected as shown below:

The Assignee appearing on the title page of the patent has been deleted in its entirety.

Signed and Sealed this

*First* Day of *April 1980*

[SEAL]

*Attest:*

*Attesting Officer*

SIDNEY A. DIAMOND

*Commissioner of Patents and Trademarks*